United States Patent [19]

Yamada et al.

[11] Patent Number: 4,604,192

[45] Date of Patent: Aug. 5, 1986

[54] POWDER CLASSIFIER

[75] Inventors: Yukiyoshi Yamada; Shin Doi, both of Saitama; Masayuki Yasuguchi, Kanagawa, all of Japan

[73] Assignees: Nisshin Flour Milling Co., Ltd.; Nisshin Engineering Co., Ltd., both of Tokyo, Japan

[21] Appl. No.: 609,094

[22] Filed: May 10, 1984

[30] Foreign Application Priority Data

May 18, 1983 [JP] Japan ..... 58-87327
Apr. 16, 1984 [JP] Japan ..... 59-76383

[51] Int. Cl.[4] ..... B07B 7/083
[52] U.S. Cl. ..... 209/144; 209/145
[58] Field of Search ..... 209/144, 145, 453; 55/394, 424; 494/35

[56] References Cited

U.S. PATENT DOCUMENTS

| | | | |
|---|---|---|---|
| 1,785,918 | 12/1930 | Stebbins | 209/144 |
| 1,973,607 | 9/1934 | Bunn | 494/35 |
| 2,367,906 | 1/1945 | Wall et al. | 209/144 |
| 2,593,294 | 4/1952 | Goldberg | 209/144 |
| 2,779,536 | 1/1957 | Pomeroy | 494/35 |
| 2,943,735 | 7/1960 | Payne et al. | 209/144 |
| 3,048,271 | 8/1962 | Sharples | 209/144 |
| 3,334,741 | 8/1967 | Hoffstrom | 209/144 |

*Primary Examiner*—S. Leon Bashore
*Assistant Examiner*—William Bond
*Attorney, Agent, or Firm*—Wenderoth, Lind & Ponack

[57] ABSTRACT

In a powder classifier of the kind having a turbine-like horizontally rotating classifying rotor which is arranged to have air diametrically flow into radial passages and to cause the coarse powder portion of a powder material supplied to the inside of the radial passages to move to a circular passage encompassing the outer circumference of the rotor and the fine powder portion of the powder material to move diametrically toward the inside of the rotor, the circular passage has a discharge port formed in a part of the outer circumferential wall thereof. To the discharge port is connected a coarse powder discharge duct which approximately tangentially extends from the discharge port of the circular passage to a chute part arranged above a coarse powder recovering device; a powder return duct is connected to the chute part and extends approximately tangentially relative to the circular passage from the chute part to an opening provided in the outer circumferential wall of the circular passage. In cases where highly adhesive ultrafine powders are treated, at least either of the coarse powder discharge duct and the powder return duct is arranged to have an air stream blown thereinto in the passing direction of the powder.

5 Claims, 6 Drawing Figures

(a)

(b)

(a)

(b)

POWDER CLASSIFIER

BACKGROUND OF THE INVENTION

1. Field of the Invention

This invention relates to an air powder classifier and more particularly to a classifier suited especially for a strongly adhesive ultrafine ceramic powder. The classifier balances a centrifugal force which is developed by the rotation of a turbine-like classifying rotor acting on particles of the powder and a counter-acting carrying force of an air flow which flows in the direction contrary to the centrifugal force.

2. Description of the Prior Art

Powder classifiers of the type using a turbine-like classifying rotor have been known as air powder classifiers suited for powders such as ceramic powders, etc. measuring several μm to 100 μm. A typical example of the known powder classifiers of this type is arranged as shown in FIGS. 1 and 2 of the accompanying drawings. As shown, the classifier has a unified combination of a classifying rotor 4 and a balance rotor 5 which is rotated around a vertical rotating shaft 3 and interposed in between an upper casing 1 and a lower casing 2. In the peripheral part of the classifying rotor 4, there is formed a radial passage type classifying chamber C. The chamber C in this case consists of many classifying blades 6 and 7 which are arranged in a radial configuration of inner and outer arrays serving as many radial partitions. The outer circumferential opening of the classifying chamber C opens to a circular passage 8 which is formed with the upper casing 1. Further, a circular clearance 9 is provided on the upper side of the classifying chamber C. In the middle part of the upper side of the upper casing 1 is provided a powder pouring inlet 10. A powder material supplied from this pouring inlet 10 is turned and moved toward the outer side of the diameter into the classifying chamber C by dispersing blades 11 which are arranged to turn and are radially formed. The upper surface of the classifying rotor 4 is opposed to the dispersing blades 11 and to the inner surface of the upper casing 1 in such a manner that the powder supplied is turned and primarily dispersed by means of the dispersing blades 11. The primarily dispersed powder is then secondarily dispersed into an evenly dispersed state by a clearance part 12 between the inner surface of the upper casing 1 and the upper surface of the classifying rotor 4.

Further, the passage type classifying chamber C of the classifying rotor 4 bends downward on the inner side of the diameter and communicates with a spiral casing part 14 through a guide passage 13 formed on the balance rotor 5 and also through the peripheral part of the balance rotor 5. The spiral casing part 14 is connected to a collector such as a cyclone, a bag filter, etc. and is arranged to have negative pressure of an air flow produced by a suctorial action of the balance rotor 5 or by a blower or the like which is not shown.

The classifier further includes an air intake port 15 which is arranged between the upper and lower casings 1 and 2 to guide air into the above stated circular passage 8. The flow of air introduced via the intake port 15 is arranged to flow only toward the inside of the circular passage 8 by virtue of the lower end flange 16 of the upper casing 1 and radial auxiliary blades 17 of the classifying rotor 4. A rotating shaft bearing 18 is arranged to carry a rotating shaft 3. A powder flow deflecting member 19 is arranged below the powder pouring inlet 10 provided in the upper side of the classifying rotor 4.

When the powder material is continuously poured into the classifier via the powder pouring inlet 10 with the rotating shaft 3 allowed to rotate at a predetermined speed, the poured powder is subjected to the primary dispersion effected by the dispersing blades 11. The primarily dispersed powder is then subjected to the secondary dispersion and enters the classifying chamber C via the circular clearance 9. Within the chamber C, a centrifugal force which is produced by the turning classifying blades 6 and 7 and an air flow which takes place due to suction exerted from the guide passage 13 to the inside relative to the diameter of the rotor 4 act on the powder. The centrifugal force causes a corse powder portion of the powder material having a larger particle size to flow outward to the circular passage 8 disposed outside the diameter of the rotor 4. Meanwhile, since the centrifugal force acts to a less degree on a fine powder portion of the powder material having a smaller particle size, the air flow carries the fine powder into the spiral casing part 14 via the passage 13. The power material thus can be continuously classified. The fine powder thus classified and separated by the classifier is supplied from the spiral casing part 14 to a collector which is a bag filter or the like. Meanwhile, the coarse powder caused to flow out to the circular passage 8 by the centrifugal force is supplied to a coarse powder recovering device via the discharge port 20 (FIG. 2) which is formed in the outer circumferential wall of the circular passage 8 and also via a duct line which extends from the discharge port 20 outward or in the tangential direction relative to the outer circumferential wall.

However, with the conventional powder classifier arranged in this manner, there have been frequent occurrences of troubles caused by powder sticking to the wall surface of the classifier. The powder sticking troubles have frequently occurred especially in the coarse powder recovering system. To solve this problem, the present inventors contrived a powder classifier wherein the duct line which guides the coarse powder from the circular passage to the coarse powder recovering device is arranged to branch out halfway and to have the branch extend back to the circular passage. The reason for the branching out of the duct line and the bringing of the branch back to the circular passage is that the coarse powder recovering device is generally operated with a rotary valve or the like in an air sealed state. This results in a stagnant air flow and positive pressure within the duct line. Under such a condition, the powder tends to stick to the inner wall surface of the duct line. Therefore, the above stated connection arrangement to bring back a portion of the duct line of the coarse powder recovering system prevents the air flow from stagnating and from aiding the powder in sticking to the duct wall halfway in the duct line, so that the above stated inconvenience can be moderated to a great extent. The present inventors conducted many tests on the powder classifier arranged in the above stated manner. As a result of the tests and studies, they found another important advantage of the classifier in addition to the prevention of the duct line from being clogged by the sticking of the powder. The advantage found resides in that the powder classifier tends to enhance a fine powder recovery percentage $\eta$. The inventors have further conducted studies on the reason for the improvement in the fine powder recovery percentage. These studies have led to the present invention.

SUMMARY OF THE INVENTION

A general object of the present invention is to provide a solution of the above stated problem of the prior art. It is a more specific object of the invention to provide a powder classifier which is capable of preventing a clog in the duct line solely by virtue of the duct connection arrangement, without recourse to a driving device such as a vibrator or the like conventionally employed in shaking off particles sticking to the wall surface of the duct line, in such a manner as to release pressure and to prevent a duct system leading to a coarse powder recovering device from coming into a blind-alley-like state, thus bringing about positive pressure there.

It is another object of the invention to provide a powder classifier which is of the above stated type having a turbine-like classifying rotor and is capable of greatly enhancing the fine powder recovery percentage $\eta$.

It is a further object of the invention to provide a powder classifier capable of effectively classifying a highly adhesive powder which has been difficult to classify by the conventional air powder classifiers. The term "a highly adhesive powder" as used herein for the purpose of this invention means, for example, an ultrafine ceramic powder, a charged alumina powder having more than 50% of its particles measuring less than 1 $\mu$m, or an agglomerative powder such as a pigment or the like.

It is a still further object of the invention to provide a powder classifier which is capable of further reducing the possibility of sticking of powder to the inside of the duct line within the coarse powder recovering system to permit a continuous operation over a long period of time or to permit classification of a highly adhesive powder material.

To attain the above stated objects, the powder classifier according to the present invention is arranged as summarily described below.

In a powder classifier of the kind wherein a horizontal rotary turbine-like classifying rotor having an air flow diametrically inward through radial passages causes the coarse powder portion of a powder material to move toward a circular passage encompassing the outer circumference of the classifying rotor and causes the fine powder portion of the powder material to move diametrically toward the inside of the classifying rotor, the circular passage is provided with a discharge port which is formed in a part of the outer circumferential wall of the circular passage; a coarse powder discharge duct line which is connected to and approximately tangentially extends from the discharge port is arranged to guide the coarse powder to a chute part disposed above a coarse powder recovering device; a powder return duct line is connected to the chute part and extends to an opening in the outer wall of the circular passage in an approximately tangential direction relative to the circular passage; and, if necessary, at least either of the coarse powder discharge duct line and the powder return duct line is arranged to have an air flow blown thereinto in the passing direction of the powder.

In the powder classifier arranged as described above according to the invention, the coarse powder discharge duct line which is connected to the circular passage in a detouring or roundabout manner is arranged to have an air flow containing the coarse powder flow without stagnating. Therefore, the powder particles do not stick to the wall of the duct. Accordingly, the particles stick to a less degree to the wall of the powder return duct line which is connected to the coarse powder discharge duct line in a branched manner. In accordance with the arrangement of the present invention, therefore, the problem of sticking of the powder particles to the duct line wall surface can be greatly moderated. In the case of a classifier of a large scale, the above stated vibrator may be replaced with the present invention or both of them may be used in combination. For a classifier of a small scale which does not readily permit installation of a vibrator, the present invention is especially useful.

In case the powder return duct line is arranged to have air blown thereinto, a positive air flow returning to the circular passage strongly acts on a coarse powder flow coming to the chute part above the coarse powder recovering device. A balance between a carrying force of this air flow and a falling force of the particles of the powder by their own weight causes most of the coarse powder particles to fall into the chute and most of the fine powder particles to move back to the circular passage via the return duct line. This permits the fine powder to be sufficiently recovered. The increase in the fine powder recovery percentage $\eta$ results from the fact that, since a part of the coarse powder flow is brought back to circulate again through the circular passage, an air flow which flows diametrically inward from the circular passage via the passages of the classifying rotor causes fine powder particles which are still contained in the coarse powder flow to be re-classified and collected. In other words, the coarse powder flow which has been once classified is partially recirculated through the circular passage and is thus classified once again. This re-classification brings about the increase in the fine powder recovery percentage.

Further, the fear of powder sticking to the inside of the duct line is mitigated by the above stated arrangement to blow in an air stream. The powder sticking problem is not only dependent on the nature of the powder particles but also greatly depends on the local stagnation of air flow through the inside of the duct line. However, the air blowing-in arrangement of the present invention smooths the flow of the powder to lessen the fear of powder sticking. To blow air into the discharge duct line, an air flow or a jet stream of air may be blown in against the wall surface of the duct line at a part where the powder most likely comes to stick. The degree to which the air flow is to be blown in varies with the dimensions of the classifier, the kind of the powder to be classified, the particles size to be classified, etc. Generally, however, air is blown in at 1 to 5 kg/cm$^2$G or preferably at 2.5 or 3.5 kg/cm$^2$G or thereabout because the internal pressure of the duct line is 0.2 to 0.3 kg/cm$^2$ under a no air blowing-in condition. Further, the pressure at which the air is to be blown in is preferably as high as possible both for preventing powder sticking and for expediting the powder circulation.

These and further objects and features of the invention will become apparent from the following detailed description of a preferred embodiment thereof taken in conjunction with the accompanying drawings.

BRIEF DESCRIPTION OF THE DRAWINGS

FIG. 3(*b*) shows a modification of the classifier shown in FIG. 3(*a*), in which an air flow is blown into a powder return duct line.

FIG. 4(*b*) is a plan view of a scraper of the embodiment shown in FIG. 3(*b*).

DETAILED DESCRIPTION OF THE PREFERRED EMBODIMENT

Figure 1:
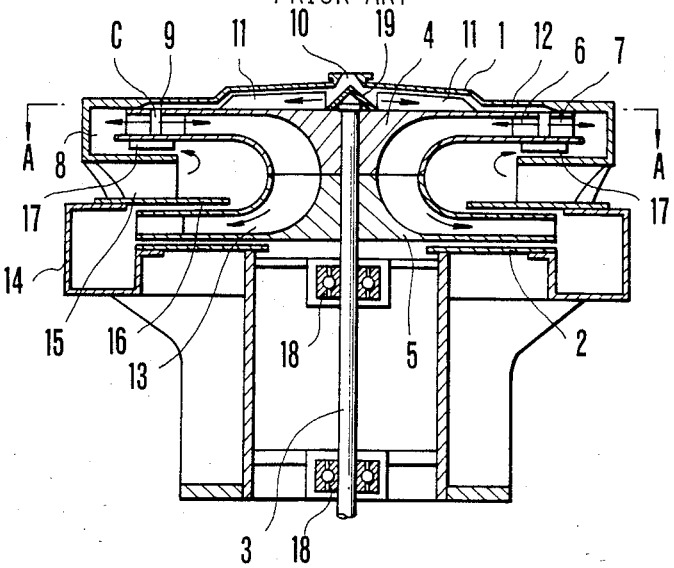
FIG.1 PRIOR ART
FIG. 1 is a vertical sectional view showing the structure of an example of the conventional powder classifier.
Figure 2:
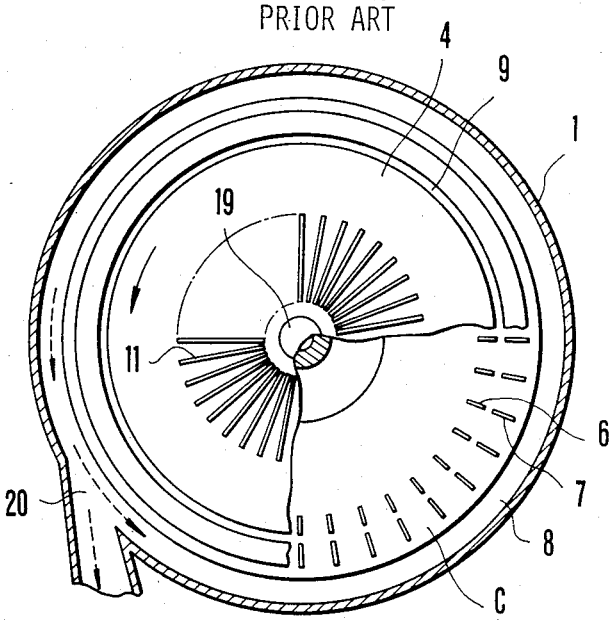
FIG.2 PRIOR ART
FIG. 2 is a sectional view taken along line A—A of FIG. 1.

The structural arrangement of the classifier body of a preferred embodiment of the invention which will be described below is substantially the same as that of the classifier of the prior art shown in FIGS. 1 and 2 and described in the foregoing. Therefore, the following description omits details of the structural arrangement of the classifier body.

Figure 3:
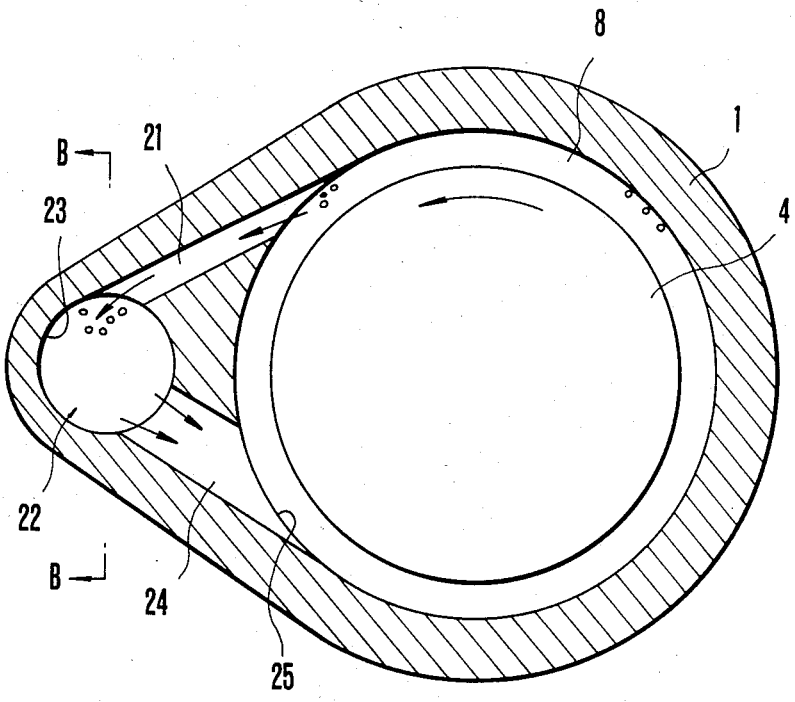
FIG. 3(*a*) is a partly sectional plan view showing a powder classifier and a coarse powder recovering system thereof which is arranged according to the basic structure of the present invention.
Figure 3:
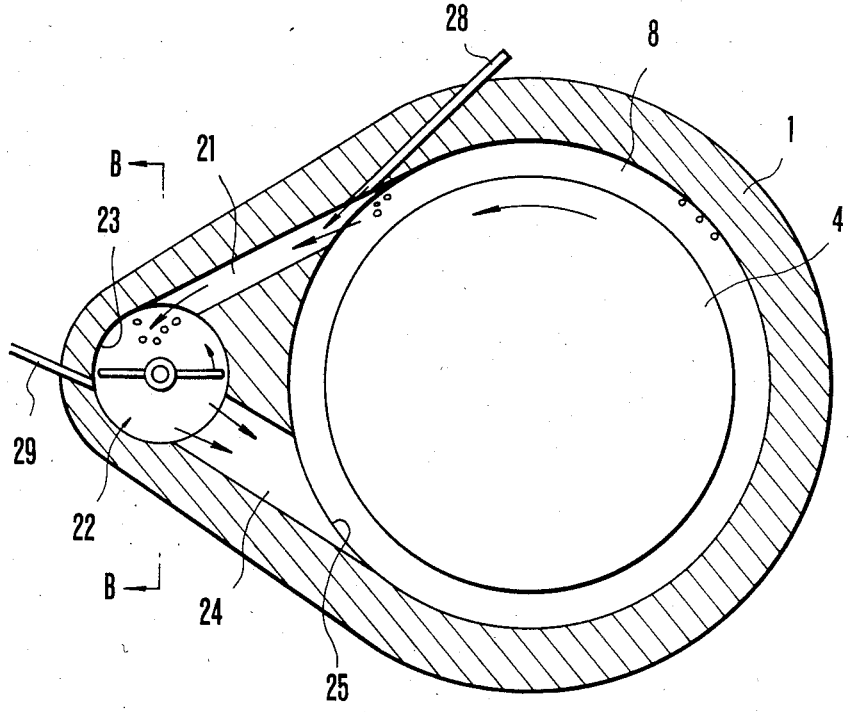

FIGS. 3(*a*), 3(*b*) and 4 show the structure of a coarse powder recovering system arranged according to the invention in combination with the classifier body. As shown in FIG. 2, a discharge port 20 is arranged in a part of the outer circumferential wall of the circular passage 8 which is formed within the classifier body. As shown in FIG. 3(*a*) and 3(*b*), a discharge duct line 21 extends approximately tangentially from the discharge port 20 (FIG. 2) of the circular passage 8 in the coarse powder discharging direction to come to a chute part arranged above a coarse powder recovering device 27 shown in FIG. 4(*a*). In the following description, the chute will be indicated by a reference numeral 23 while an opening part above it will be referred to as a coarse powder falling or precipitating part 22 at which the coarse powder precipitates and is separated.

This coarse powder precipitating part 22 shown in FIGS. 3(*a*), 3(*b*), and 4(*a*) is connected in a tangentially returnable manner to the above stated circular passage 8 via a return duct line 24 which is connected to the discharge duct line 21 approximately in an L shape. A reference numeral 25 in FIGS. 3(*a*) and 3(*b*) denotes a partial return port at which the return duct line 24 is connected to the outer circumferential wall of the circular passage 8 in such a way as to open into the circular passage 8. A vertical duct line 26 shown in FIG. 4(*a*) is arranged to connect the chute 23 opening below the coarse powder precipitating part 22 to a coarse powder recovering device 27 which is located below the chute 23. In this specific example, the coarse powder precipitating part 22 and the vertical duct line 25 of FIGS. 3(*a*) and 3(*b*) are formed into one tubular shape. The upper part of this tube opens into both the discharge duct line 21 and the return duct line 24.

In the event of a classifying operation on a highly adhesive ultrafine ceramic powder or the like, the modification shown in FIG. 3(*b*) is advantageous. In FIG. 3(*b*), an air blowing-in tube 28 is arranged to blow in an air stream in the vicinity of the discharge duct line 21 in such a way as to flow approximately along the flow of the coarse powder coming from the circular passage 8. Meanwhile, the return duct line 24 is preferably also provided with another air blowing-in tube 29 which is arranged to blow in an air stream through the coarse powder precipitating part 22 located above the chute 23 toward the circular passage 8.

Figure 4:
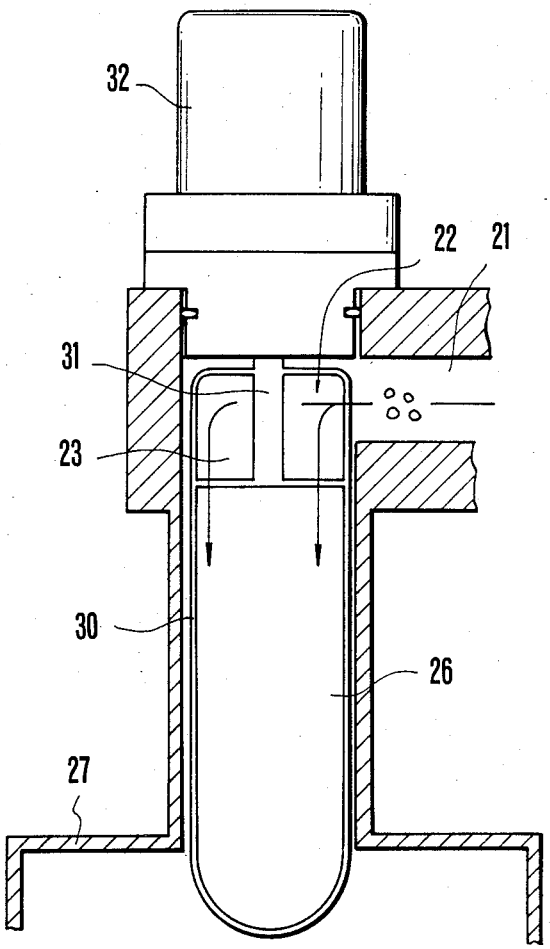
FIG. 4(*a*) is a sectional view taken along line B—B of FIG. 3(*b*).
Figure 4:
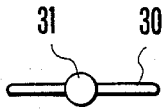

Further, as shown in FIG. 4(*a*), the tubular part consisting of the coarse powder precipitating part 22 and the vertical duct line 26 is provided with a scraper 30 for scraping off any powder that is sticking to the wall surface of the tubular part. The scraper 30 is composed of a vertically long wiry frame body of a width a little shorter than the diameter of the tubular part. The scraper frame body is hung on a rotating shaft 31 which is arranged to be rotated by a motor 32 disposed above the classifier.

The classifier which is arranged as described above and shown in FIG. 3(*a*) operates as follows: At the classifier body, the powder material supplied thereto is classified by the classifying rotor 4 in a manner which has been described with reference to FIGS. 1 and 2. A coarse powder portion of the powder supplied is moved in general to the circular passage 8 and a fine powder portion to the inside of the classifying rotor 4. Returning to FIG. 1, it may be seen that the fine powder comes to the spiral casing part 14 via the guide passage 13 and is then collected by a suitable collecting device. The coarse powder which is moved to the circular passage 8 circulates as the classifying rotor 4 rotates (in the direction of the arrow) and flows out from the discharge port 20 (FIG. 2) to the discharge duct line 21 shown in FIGS. 3(*a*) and 3(*b*).

In the event of a classifying operation on a highly adhesive ultrafine ceramic powder or the like using the classifier shown in FIG. 3(*b*), air is blown in from the air blowing tube 28 into the flow of the coarse powder flowing into the discharge duct line 21. An air flow within the discharge duct line 21 is accelerated by the air thus blown in to prompt the coarse powder to flow into the coarse powder precipitating part 22. In this specific embodiment, the direction of the air blowing-in tube 28 is somewhat tilted as shown in FIG. 3(*b*) in such a manner as to have an air stream impinge upon the inner wall surface and thus to effectively prevent the powder from sticking to the inner wall surface of the duct line 21 to which the powder tends to stick. Then, depending on a balance between the carrying force of the air flow and precipitation by gravity, the coarse powder which arrives at the coarse powder precipitating part 22 has its large particles precipitate via the chute 23 into the vertical duct line 26 shown in FIG. 4(*a*) and disposed above the coarse powder recovering device 27. Meanwhile, smaller particles included in the coarse powder do not readily precipitate by gravity. Thus, as shown in FIG. 3(*b*) since air is blown into the return duct line 24 from the air blowing-in tube 29 which opens at the coarse powder precipitating part 22, an air flow developed by this blowing carries the smaller particles into the return duct line 24 and further back into the circular passage 8. The powder returned to the outer circumferential wall 8 circulates along the circular passage as the classifying rotor 4 rotates and is subjected to a re-classifying action.

Therefore, fine particles smaller than a predetermined particle size come through passages of the classifying rotor 4 to be recovered by the collecting device provided for the fine powder.

The above stated flow of the powder continuously and repeatedly takes place within the powder classifier to have the fine and coarse powder portions of the powder material separated from each other.

With the basic structure of the present invention as shown in FIG. 3(*a*), the coarse powder which is classified as the classifier operates is caused by the centrifugal force to flow out from the classifying rotor 4 to the circular passage 8. Then, a vortex flow of air causes the effluent coarse powder to be guided into the discharge duct line 21 which opens from, to the circular passage 8. The coarse powder then precipitates at the curved portion of the discharge duct line 21 while flowing therethrough. The precipitated coarse powder falls through the coarse powder precipitating part 22 to be recovered by the coarse powder recovering device 27 shown in FIG. 4(*a*). However, as may be best seen in FIG. 3(*a*), some portion of the coarse powder is allowed to continuously circulate by passaging through the curved part of the return duct line 24 back to the circular passage 8. This arrangement thus prevents the air flow from stagnating within the discharge duct line 21 and thus quite effectively prevents the coarse powder from sticking to the wall surface of the discharge duct line 21.

Meanwhile, as shown in FIG. 4(*a*) the coarse powder precipitating part 22 which is connected to the recovering device 27 below the discharge duct line 21 present a sort of an air sealed condition. However, since the coarse powder precipitating part 22 is branched out downward from the discharge duct line 21, there arises no serious stagnation of air flow. Therefore, the possibility of sticking of the coarse powder to the wall surface can be reduced to a great extent in accordance with the arrangement of this embodiment.

Results of experiments conducted by the inventors indicated that the coarse powder recovering mechanism of the classifier using the guide duct line which comprises the above stated discharge duct line and the coarse powder precipitating part in combination alleviated the problem of sticking of powder to the wall surface. Particularly, in the case of a small powder classifier adapted for fine powder of particle size measuring several μm, application of the invention permitted a long continuous operation of the classifier without recourse to use of a vibration imparting device for the guide duct line. It is an additional advantage of this basic structure that some fine powder portion can be reclassified and separated from the stream of coarse powder. More specifically, in the case of this embodiment, the coarse powder is introduced from the discharge duct line 21 to the coarse powder precipitating part 22 by virtue of gravitational precipitation as described in the foregoing discussion. Therefore, the smaller mass particles, i.e. fine powder particles on which the powder particle carrying action of an air flow is exerted to a greater degree are carried by the air flow flowing through the discharge duct line 21 without falling into the fall port 23 and are thus brought back to the circular passage 8. As a result, the powder recovered via the chute 23 and the coarse powder precipitating part 22 by the recovering device includes a fine powder portion to a less degree.

The arrangement to blow air into the duct line by means of the air blowing-in tubes 28 and 29 as shown in FIG. 3(*b*), not only enhances the powder carrying force to prompt the fine powder to more smoothly circulate but also effectively prevents the powder from sticking to the wall surface of the duct line. In other words, the air blown into the return duct line 24 mainly serves to expedite the circulation of the powder while the air blown into the discharge duct line 21 mainly serves to prevent sticking of the powder.

It has been confirmed through experiments that the fine powder recovery percentage $\eta$ can be greatly enhanced by the air blown into the return duct line 24. Further, with the embodiment arranged to have air blown into both the discharge and return duct lines, the embodiment is capable of classifying such highly adhesive powder that has been difficult to classify with the conventional powder classifiers. Therefore, agglomerative powder materials such as ultrafine ceramic powder, charged powder, and pigments obtained from chemical processes can be classified.

Figure 5:
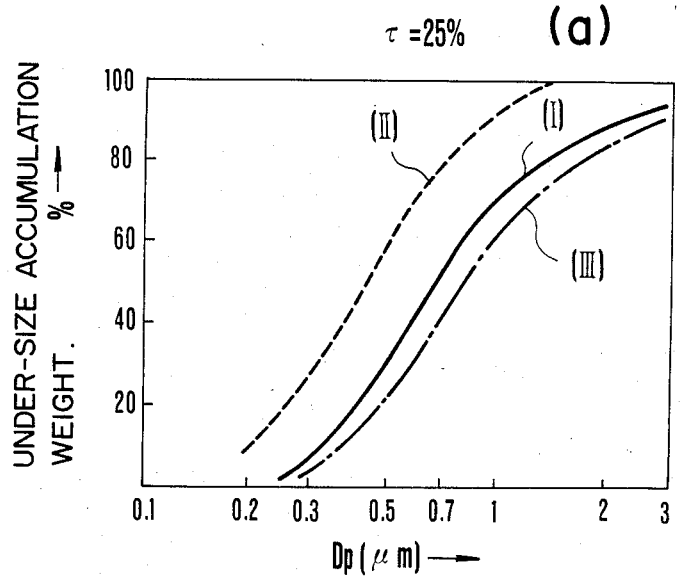
FIGS. 5(*a*) and 5(*b*) are graphs showing particle size distribution before and after classification, FIG. 5(*a*) showing the results of powder classification obtained by the conventional classifier and FIG. 5(*b*) the results obtained by the classifier arranged according to the present invention.
Figure 5:
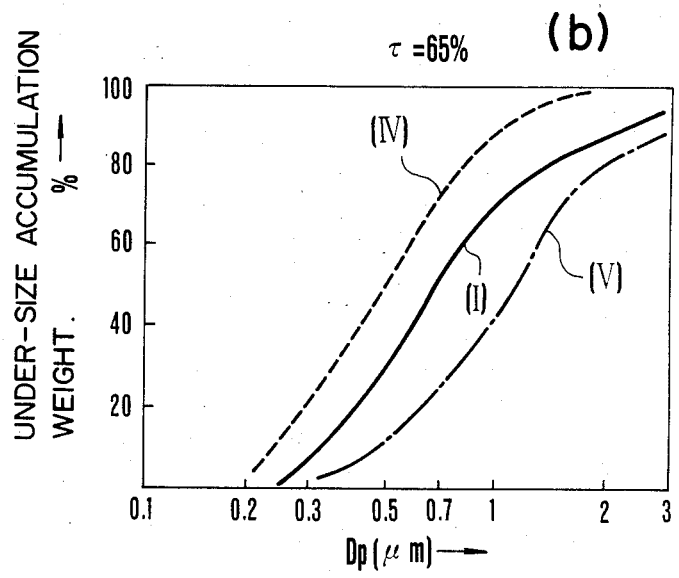

FIGS. 5(*a*) and 5(*b*) show the results of classifying tests conducted on an alumina powder material including at least 70% of particles measuring less than 1 μm with the classifier described in the foregoing discussion. The classifier was operated without blowing air into the duct line in the case shown in FIG. 5(*a*) and with air blown into the duct line in the case of shown in FIG. 5(*b*). In the latter case, air was blown in at a blowing-in pressure of 3.0 $kg/cm^2G$ via both the air blowing-in tubes 28 and 29. In FIGS. 5(*a*) and 5(*b*), a curve (I) shows the particle size distribution of the powder material. Curves (II) and (IV) show the particle size distribution of fine powder recovered respectively. Curves (III) and (V) respectively show the particle size distribution of coarse powder recovered. The fine powder recovery percentage $\eta$ was 25% in the case of FIG. 5(*a*) and 65% in the case of FIG. 5(*b*). As it is apparent from the test results shown, the particle size distribution is about the same in both the fine powder recovered and the coarse powder recovered. The fine powder recovery percentage $\eta$ for particle size less than 1 μm is 65% in the case of the embodiment of the invention thus showing a great increase over that of the conventional classifier which is about 40%. It has been also confirmed through experiments that the classifying operation on the above stated powder material can be continuously performed over a period of 8 hours with the embodiment of the invention. This performance proves the practicability of the invention.

The invention is not limited to the embodiment described but is of course applicable to a classifier adapted for a powder material exceeding several μm in particle size.

The air stream blowing-in arrangement may be applied only to the coarse powder discharge duct line or to the coarse powder return duct line instead of applying it to both of them. Further, the position and direction of the air blowing-in arrangement are alterable as desired in so far as such alteration does not come to impede the intended impartment of a powder carrying force to the air flow or the prevention of the sticking of the powder. The air blowing-in direction may be arranged to be slanting at some angle to the duct line. Further, in the specific embodiment described, the powder return duct line is arranged to have a larger diameter in consideration of the air stream to be blow thereinto. However, the return duct line does not need a larger diameter.

The powder classifier according to the present invention, as has been described in the foregoing specification, not only solves the problem of the coarse powder recovering system of the conventional classifier but also greatly enhances the fine powder recovery percentage by expediting the recirculation of the coarse powder to the classifying chamber. It is another great advantage of the present invention that the classifier according to the invention is capable of classifying such highly adhesive powder materials that have been difficult to process with the conventional powder classifiers.

What we claim is:

1. In a powder classifier having:

a horizontally rotating turbine-like classifying rotor with an outer circumference;

a circular passage encompassing the outer circumference of the rotor and having the classifying rotor centered therein; and an inlet means, positioned above the classifying rotor in the circular passage, for feeding powder thereinto, said powder having a coarse portion and a fine portion;

an improvement comprising:

duct means, connected at one end to the circular passage and extending therefrom in a direction approximately tangential to the circular passage, for discharging a flow of air, the coarse portion of the powder, and the fine portion of the powder from the classifying rotor;

means, connected at an opposite end of the discharging duct means, for precipitating the coarse portion of the powder from the flow of the air and the fine portion of the powder; and duct means, connected at one end to the precipitating means and connected at an opposite end to the circular passage, for recirculating the flow of the air and the fine portion of the powder to the classifying rotor.

2. In the powder classifier according to claim 1, wherein the improvement further comprises:

first means, arranged in the discharging duct means, for blowing air thereinto along the flow of the air so that the powder is prevented from sticking in said discharging duct means.

3. In the powder classifier according to claim 2, wherein the improvement further comprises:

second means, arranged in communication with the recirculating duct means, for blowing air thereinto along the flow of the air so that the fine portion of the powder is prevented from sticking in said recirculating duct means.

4. In the powder classifier according to claim 1, wherein the improvement further comprises:

rotatable means, arranged in the precipitating means, for scraping off powder sticking in said precipitating means.

5. In the powder classifier according to claim 1, in the improvement, wherein:

said precipitating means has a cylindrical shape.

* * * * *